US012618326B2

(12) United States Patent
Jin et al.

(10) Patent No.: US 12,618,326 B2
(45) Date of Patent: May 5, 2026

(54) DEVICES AND METHODS FOR OIL FIELD SPECIALTY CHEMICAL DEVELOPMENT AND TESTING

(71) Applicant: ChampionX USA Inc., Sugar Land, TX (US)

(72) Inventors: Ming-Zhao Jin, Edmonton (CA); Peiqi Qiao, Calgary (CA); Dingzheng Yang, Edmonton (CA); Song Gao, Calgary (CA)

(73) Assignee: ChampionX USA Inc., Sugar Land, TX (US)

( * ) Notice: Subject to any disclaimer, the term of this patent is extended or adjusted under 35 U.S.C. 154(b) by 566 days.

(21) Appl. No.: 18/165,709

(22) Filed: Feb. 7, 2023

(65) Prior Publication Data

US 2023/0258081 A1 Aug. 17, 2023

(30) Foreign Application Priority Data

Feb. 11, 2022 (CA) ..... 3148574

(51) Int. Cl.
*E21B 49/08* (2006.01)
*E21B 43/16* (2006.01)

(52) U.S. Cl.
CPC ..... *E21B 49/087* (2013.01); *E21B 43/16* (2013.01)

(58) Field of Classification Search
CPC ..... H02M 1/0019; H02M 3/1566; H02M 1/0054; H02M 3/1584
See application file for complete search history.

(56) References Cited

U.S. PATENT DOCUMENTS 6,317,654 B1 11/2001 Gleeson et al.
8,510,242 B2 8/2013 Al-Fattah
(Continued)

FOREIGN PATENT DOCUMENTS

WO 2015/032505 A1 3/2015
WO 2021/216173 A1 10/2021

OTHER PUBLICATIONS

Written Opinion mailed on Jun. 26, 2023, received for EP23156190, filed on Feb. 10, 2023, 4 pages (Year: 2023).*
(Continued)

*Primary Examiner* — Mi'Schita' Henson
(74) *Attorney, Agent, or Firm* — Eric D. Babych; Barnes & Thornburg LLP

(57) ABSTRACT

Technologies for specialty chemical development and testing include devices and methods for receiving a test description. The test description is indicative of test parameters for a test of a chemical formulation, which may be an oil field specialty chemical. The devices and methods may include searching a database of historical test results based on similarity to the test parameters to generate multiple candidate chemical formulations. The devices and methods may cluster the candidate chemical formulations with an unsupervised machine learning algorithm to select a representative chemical formulation for each cluster. The devices and methods may include training a predictor based on test results using a supervised machine learning algorithm. Multiple virtual formulations may be generated and performances of each virtual formulation may be predicted with the predictor. Other embodiments are described and claimed.

20 Claims, 7 Drawing Sheets

(56) References Cited

U.S. PATENT DOCUMENTS

| | | | | |
|---|---|---|---|---|
| 8,893,784 | B2 | 11/2014 | Abad | |
| 8,988,236 | B2 | 3/2015 | Liu et al. | |
| 9,085,975 | B2 | 7/2015 | Abad | |
| 9,732,372 | B2 * | 8/2017 | Fajt | C02F 1/008 |
| 10,619,089 | B2 | 4/2020 | Chang et al. | |
| 10,622,098 | B2 | 4/2020 | Coley et al. | |
| 10,859,558 | B2 | 12/2020 | Zielinski et al. | |
| 10,943,182 | B2 | 3/2021 | Bryant et al. | |
| 2006/0289359 | A1 * | 12/2006 | Manek | C02F 1/682 210/708 |
| 2017/0161635 | A1 | 6/2017 | Oono et al. | |
| 2019/0278880 | A1 | 9/2019 | Ma et al. | |
| 2019/0286792 | A1 | 9/2019 | Li et al. | |
| 2020/0042671 | A1 * | 2/2020 | Martin | G06F 16/316 |
| 2020/0167647 | A1 | 5/2020 | De Waele et al. | |
| 2021/0027864 | A1 | 1/2021 | Plumbley et al. | |
| 2021/0104331 | A1 | 4/2021 | Mysore et al. | |
| 2021/0134398 | A1 | 5/2021 | Wise et al. | |
| 2022/0397886 | A1 * | 12/2022 | Hong | G05B 19/4155 |
| 2025/0140355 | A1 * | 5/2025 | Maua | G16C 20/30 |

OTHER PUBLICATIONS

Heck, Gabriela S. et al. "Supervised Machine Learning Methods Applied to Predict Ligand-Binding Affinity," Current Medicinal Chemistry, 2017, 24(23), 1-12.

Sun, Wenbo et al. "Machine learning-assisted molecular design and efficiency prediction for high-performance organic photovoltaic materials," Science Advances, 2019, 5(11), 1-8.

Blazquez, Christian, et al. 'Crude Oil Foams Testing and Ranking of Antifoams with the Depressurization Test'. Energy & Fuels, vol. 31, Dec. 2016, https://doi.org10.1021/acs.energyfuels.6b02567.

Raynel, Guillaume, et al. 'A New Method to Select Demulsifiers and Optimize Dosage at Wet Crude Oil Separation Facilities'. Oil & Gas Science and Technology, vol. 76, Jan. 2021, p. 19, https://doi.org10.2516/ogst/2020096.

Shadravan et al., "Intelligent Tool To Design Drilling, Spacer, Cement Slurry, and Fracturing Fluids by Use of Machine-Learning Algorithms", SPE Drilling & Completion, 30 (02), pp. 131-140, https://doi.org/10.2118/175238-PA, Mar. 17, 2017 (Mar. 17, 2017).

* cited by examiner

500

502 504 506

| TEST DESCRIPTION | | |
|---|---|---|
| FIELD | VALUE | WEIGHT(%) |
| PROJECT ID | ID# | |
| CUSTOMER | CUSTNAME | |
| SITE | SITENAME | |
| PAD | A | |
| WELL/WELLS | B | |
| CURRENT CHEMICAL | CHEM A | |
| TREATING TEMP (C) | 150 | 25 |
| TREATING DOSAGE (ppm) | 200 | 25 |
| RESIDENCE TIME (min) | 180 | |
| TESTER | @TESTER | |
| TEST DATE | DATE | |
| PROD. (OIL/WATER) (BPD) | 1000/2000 | |
| API GRAVITY | 14 | |
| GPS (LAT/LONG) | 57.0/-112.0 | 50 |
| • • • | | |
| TOTAL | | 100 |

FIG. 5

600

602

PRE-TEST RECOMMENDATION REPORT

| TOP TESTED | | |
|---|---|---|
| NAME | COMPOSITION | TEST DETAILS |
| • • • | | |

604

| UNTESTED | |
|---|---|
| NAME | COMPOSITION |
| • • • | |

606

FIG. 6

700

702

| NAME | COMPONENT PROPORTION (%) | | | | | | | | |
|---|---|---|---|---|---|---|---|---|---|
| | G | H | M | K | I | A | C | L | F |
| CHEM 1 | 40 | 0 | 0 | 60 | 0 | 0 | 0 | 0 | 0 |
| CHEM 2 | 40 | 0 | 0 | 60 | 0 | 0 | 0 | 0 | 0 |
| CHEM 3 | 40 | 0 | 0 | 60 | 0 | 0 | 0 | 0 | 0 |
| CHEM 4 | 40 | 0 | 0 | 60 | 0 | 0 | 0 | 0 | 0 |
| CHEM 5 | 50 | 0 | 0 | 50 | 0 | 0 | 0 | 0 | 0 |
| CHEM 6 | 40 | 0 | 0 | 60 | 0 | 0 | 0 | 0 | 0 |
| CHEM 7 | 50 | 0 | 0 | 50 | 0 | 0 | 0 | 0 | 0 |
| CHEM 8 | 40 | 0 | 0 | 50 | 0 | 10 | 0 | 0 | 0 |
| CHEM 9 | 0 | 30 | 0 | 50 | 0 | 0 | 0 | 0 | 20 |
| CHEM 10 | 0 | 0 | 0 | 50 | 50 | 0 | 0 | 0 | 0 |
| CHEM 11 | 0 | 30 | 10 | 40 | 0 | 0 | 0 | 0 | 20 |
| CHEM 12 | 0 | 30 | 0 | 50 | 0 | 0 | 0 | 0 | 20 |
| CHEM 13 | 0 | 40 | 0 | 50 | 0 | 10 | 0 | 0 | 0 |
| CHEM 14 | 0 | 40 | 0 | 50 | 0 | 10 | 0 | 0 | 0 |
| CHEM 15 | 0 | 30 | 0 | 0 | 50 | 0 | 0 | 0 | 20 |
| CHEM 16 | 77.8 | 0 | 22.2 | 0 | 0 | 0 | 0 | 0 | 0 |
| CHEM 17 | 80 | 0 | 0 | 0 | 0 | 20 | 0 | 0 | 0 |
| CHEM 18 | 52.7 | 0 | 0 | 0 | 0 | 23.6 | 23.6 | 0 | 0 |
| CHEM 19 | 85 | 15 | 0 | 0 | 0 | 0 | 0 | 0 | 0 |
| CHEM 20 | 30.4 | 0 | 69.6 | 0 | 0 | 0 | 0 | 0 | 0 |
| CHEM 21 | 82.5 | 17.5 | 0 | 0 | 0 | 0 | 0 | 0 | 0 |
| CHEM 22 | 50 | 0 | 0 | 0 | 0 | 0 | 0 | 50 | 0 |
| CHEM 23 | 85 | 0 | 0 | 0 | 0 | 15 | 0 | 0 | 0 |
| CHEM 24 | 66 | 0 | 33 | 0 | 0 | 0 | 0 | 0 | 0 |

710 712 714

704 706 708

FIG. 7

800

804

806

802

| NAME | NUMERIC FEATURE | (%) | | | PREDICTED KPI SCORE |
|---|---|---|---|---|---|
| | | A | C | F | |
| VF06 | 12.51472579 | 60 | 0 | 40 | 0.998035 |
| VF17 | 15.87182323 | 50 | 0 | 50 | 0.868883 |
| VF02 | 9.984466861 | 85 | 0 | 15 | 0.861913 |
| VF14 | 15.01465913 | 50 | 10 | 40 | 0.827223 |
| VF01 | 8.687055708 | 30.4 | 0 | 0 | 0.766398 |
| VF04 | 11.07443825 | 33 | 0 | 0 | 0.766398 |
| VF03 | 11.03592964 | 20 | 0 | 0 | 0.738686 |
| VF05 | 11.57877373 | 28.5 | 0 | 0 | 0.732032 |
| VF18 | 16.33466135 | 0 | 0 | 100 | 0.630831 |
| VF10 | 13.78803764 | 40 | 0 | 60 | 0.604973 |
| VF08 | 12.84692629 | 20 | 0 | 80 | 0.586881 |
| VF15 | 15.37967746 | 15 | 0 | 85 | 0.582304 |
| VF12 | 14.08765703 | 0 | 0 | 72 | 0.540144 |
| VF20 | 18.4951163 | 0 | 28 | 72 | 0.456962 |
| VF09 | 13.4356937 | 40 | 30 | 0 | 0.437988 |
| VF11 | 14.05693155 | 50 | 50 | 0 | 0.388598 |
| VF19 | 17.05910123 | 0 | 40 | 60 | 0.370383 |
| VF07 | 12.54145307 | 40 | 60 | 0 | 0.346742 |
| VF16 | 15.53184041 | 20 | 50 | 30 | 0.279689 |
| VF13 | 14.78341792 | 0 | 100 | 0 | 0.08239 |

FIG. 8

DEVICES AND METHODS FOR OIL FIELD SPECIALTY CHEMICAL DEVELOPMENT AND TESTING

BACKGROUND

Several types of specialty chemicals, such as demulsifiers, corrosion inhibitors, scale inhibitors, and defoamers, are used during oil and/or gas production. Due to complicated formulation and application scenarios, selection and development of the specialty chemicals is typically an empirical process.

SUMMARY

According to one aspect, of the disclosure, a computing device for specialty chemical development testing includes a tester interface and a pre-test recommendation module. The tester interface is to receive a test description indicative of a test parameter for a test of a chemical formulation, wherein the test parameter comprises an oil field process parameter. The pre-test recommendation module is to search a database of historical test results based on similarity to the test parameter of the test description to generate a plurality of search results, and generate a plurality of candidate chemical formulations in response to a search of the database. Each of the plurality of candidate chemical formulations is associated with a search result of the plurality of search results.

In an embodiment, the chemical formulation comprises an oil field specialty chemical. In an embodiment, the oil field specialty chemical comprises a demulsifier, a dispersant, a corrosion inhibitor, or a defoamer. In an embodiment, the oil field process parameter comprises a geometrical location, a treating temperature, a treating pressure, a reservoir type, a crude oil pump method parameter, or a crude oil characterization. In an embodiment, to search the database comprises to perform a multidimensional distance search of the historical test results based on the test parameter.

In an embodiment, the computing device further includes a formulation cluster module to cluster the plurality of candidate chemical formulations with an unsupervised machine learning algorithm to generate a plurality of formulation clusters; and select a representative chemical formulation for each of the plurality of formulation clusters. In an embodiment, the unsupervised machine learning algorithm comprises a k-means clustering algorithm.

In an embodiment, the tester interface is further to receive a plurality of test results in response to selection of the representative chemical formulation, wherein each of the plurality of test results is indicative of a performance indicator for a corresponding representative chemical formulation. In an embodiment, the performance indicator comprises turbidity, top oil total water content, or water recovery speed.

In an embodiment, the computing device further includes a formulation optimizer module to train a predictor with the plurality of test results using a supervised machine learning algorithm. In an embodiment, the predictor comprises a regressor. In an embodiment, the predictor comprises a random forest classifier.

In an embodiment, the formulation optimizer module is further to generate a plurality of virtual formulation candidates, wherein each of the plurality of virtual formulation candidates is indicative of a proportion of a chemical; and predict a plurality of predicted results with the predictor in response to training of the predictor, wherein each of the plurality of predicted results is indicative of the performance indicator for a corresponding virtual formulation candidate of the plurality of virtual formulation candidates.

In an embodiment, the tester interface is further to receive a plurality of second test results in response to prediction of the plurality of predicted results, wherein each of the plurality of second test results is indicative of a performance indicator for a corresponding virtual formulation candidate of the plurality of virtual formulation candidates; and the formulation optimizer module is further to train the predictor with the plurality of second test results using the supervised machine learning algorithm.

According to another aspect, a method for specialty chemical development testing includes receiving, by a computing device, a test description indicative of a test parameter for a test of a chemical formulation, wherein the test parameter comprises an oil field process parameter; searching, by the computing device, a database of historical test results based on similarity to the test parameter of the test description to generate a plurality of search results; and generating, by the computing device, a plurality of candidate chemical formulations in response to searching the database, wherein each of the plurality of candidate chemical formulations is associated with a search result of the plurality of search results.

In an embodiment, the chemical formulation comprises an oil field specialty chemical. In an embodiment, the oil field specialty chemical comprises a demulsifier, a dispersant, a corrosion inhibitor, or a defoamer. In an embodiment, the oil field process parameter comprises a geometrical location, a treating temperature, a treating pressure, a reservoir type, a crude oil pump method parameter, or a crude oil characterization. In an embodiment, searching the database comprises performing a multidimensional distance search of the historical test results based on the test parameters.

In an embodiment, the method further includes clustering, by the computing device, the plurality of candidate chemical formulations with an unsupervised machine learning algorithm to generate a plurality of formulation clusters; and selecting, by the computing device, a representative chemical formulation for each of the plurality of formulation clusters. In an embodiment, the unsupervised machine learning algorithm comprises a k-means clustering algorithm.

In an embodiment, the method further includes receiving, by the computing device, a plurality of test results in response to selecting the representative chemical formulation, wherein each of the plurality of test results is indicative of a performance indicator for a corresponding representative chemical formulation. In an embodiment, the performance indicator comprises turbidity, top oil total water content, or water recovery speed.

In an embodiment, the method further includes training, by the computing device, a predictor with the plurality of test results using a supervised machine learning algorithm. In an embodiment, the predictor comprises a regressor. In an embodiment, the predictor comprises a random forest classifier.

In an embodiment, the method further includes generating, by the computing device, a plurality of virtual formulation candidates, wherein each of the plurality of virtual formulation candidates is indicative of a proportion of a chemical; and predicting, by the computing device, a plurality of predicted results with the predictor in response to training the predictor, wherein each of the plurality of predicted results is indicative of the performance indicator for a corresponding virtual formulation candidate of the plurality of virtual formulation candidates.

In an embodiment, the method further includes receiving, by the computing device, a plurality of second test results in response to predicting the plurality of predicted results, wherein each of the plurality of second test results is indicative of a performance indicator for a corresponding virtual formulation candidate of the plurality of virtual formulation candidates; and training, by the computing device, the predictor with the plurality of second test results using the supervised machine learning algorithm.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

FIG. 5 is a schematic diagram illustrating at least one embodiment of a test description that may be processed by the computing device of FIGS. 1 and 2;

FIG. 6 is a schematic diagram illustrating at least one embodiment of a pre-test recommendation report that may be generated by the computing device of FIGS. 1 and 2;

FIG. 7 is a schematic diagram illustrating at least one embodiment of a formulation clustering that may be performed by the computing device of FIGS. 1 and 2; and FIG. 8 is a schematic diagram illustrating at least one embodiment of predicted results that may be generated by the computing device of FIGS. 1 and 2.

DETAILED DESCRIPTION OF THE DRAWINGS

Figure 1:
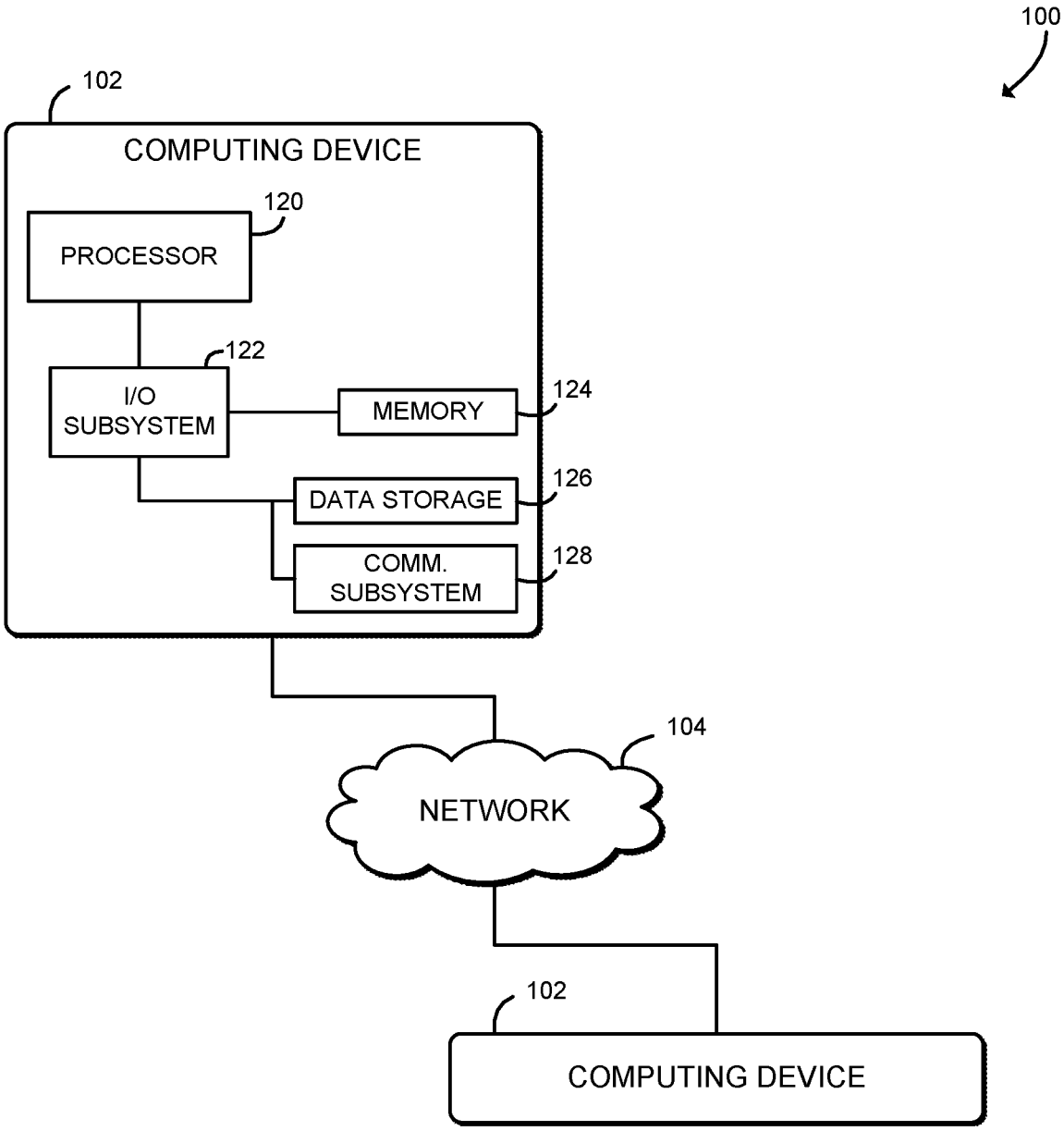
FIG. 1 is a simplified block diagram of at least one embodiment of a system for specialty chemical development and testing.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C): (A and B); (B and C); or (A, B, and C). Similarly, items listed in the form of "at least one of A, B, or C" can mean (A); (B); (C): (A and B); (B and C); or (A, B, and C).

The disclosed embodiments may be implemented, in some cases, in hardware, firmware, software, or any combination thereof. The disclosed embodiments may also be implemented as instructions carried by or stored on a transitory or non-transitory machine-readable (e.g., computer-readable) storage medium, which may be read and executed by one or more processors or processing units (e.g., GPUs, or tensor processing units (TPUs)). A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

Referring now to FIG. 1, an illustrative system 100 includes a computing device 102 that may be in communication with multiple additional computing devices 102 over a network 104. In use, as described further below, a tester provides a test description for a test of a specialty chemical to a computing device 102, for example through a website or other client-server interface, or alternatively directly with a user interface of the computing device 102. The computing device 102 may generate a pre-test recommendation of candidate chemical formulations by searching a database of historical test results for similar tests. As described further below, such databases may include data lakes or databases such as SQL, NoSQL, MongoDB, or the like. Additionally, the computing device 102 may cluster candidate formulations into multiple clusters and then select representative formulations for testing. The computing device 102 may further train a predictor (e.g., a regressor or a classifier) based on test results and then use the trained predictor to predict test results for multiple virtual formulations. The tester may use the pre-test recommendation, the clustered, representative formulations and/or the predicted results to guide development and testing of the specialty chemical. Thus, the system 100 may provide a platform with machine-learning technology to enable improved development and testing of specialty chemicals, such as oil field specialty chemicals. In particular, the system 100 enables a shortened development/selection process and may lead to increase performance of resulting specialty chemicals.

The computing device 102 may be embodied as any type of device capable of performing the functions described herein. For example, a computing device 102 may be embodied as, without limitation, a server, a rack-mounted server, a blade server, a workstation, a network appliance, a web appliance, a desktop computer, a laptop computer, a tablet computer, a smartphone, a consumer electronic device, a distributed computing system, a multiprocessor system, and/or any other computing device capable of performing the functions described herein. Additionally, in some embodiments, the computing device 102 may be embodied as a "virtual server" formed from multiple computing devices distributed across the network 104 and operating in a public or private cloud. Accordingly, although each computing device 102 is illustrated in FIG. 1 as embodied as a single computing device, it should be appreciated that each computing device 102 may be embodied as multiple devices cooperating together to facilitate the functionality described below. As shown in FIG. 1, the illustrative computing device 102 includes a processor 120, an I/O subsystem 122, memory 124, a data storage device 126, and a communication subsystem 128. Of course, the computing device 102 may include other or additional components, such as those commonly found in a server computer (e.g., various input/output devices), in other embodiments. Additionally, in some embodiments, one or more of the illustrative components may be incorporated in, or otherwise form a portion of, another component. For example, the memory 124, or portions thereof, may be incorporated in the processor 120 in some embodiments.

The processor 120 may be embodied as any type of processor or compute engine capable of performing the functions described herein. For example, the processor may be embodied as a single or multi-core processor(s), digital signal processor, microcontroller, or other processor or processing/controlling circuit. Similarly, the memory 124 may be embodied as any type of volatile or non-volatile memory or data storage capable of performing the functions described herein. In operation, the memory 124 may store various data and software used during operation of the computing device 102 such as operating systems, applications, programs, libraries, and drivers. The memory 124 is communicatively coupled to the processor 120 via the I/O subsystem 122, which may be embodied as circuitry and/or components to facilitate input/output operations with the processor 120, the memory 124, and other components of the computing device 102. For example, the I/O subsystem 122 may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations. In some embodiments, the I/O subsystem 122 may form a portion of a system-on-a-chip (SoC) and be incorporated, along with the processor 120, the memory 124, and other components of the computing device 102, on a single integrated circuit chip.

The data storage device 126 may be embodied as any type of device or devices configured for short-term or long-term storage of data such as, for example, memory devices and circuits, memory cards, hard disk drives, solid-state drives, or other data storage devices. The communication subsystem 128 of the computing device 102 may be embodied as any communication circuit, device, or collection thereof, capable of enabling communications between the computing device 102 and other remote devices. The communication subsystem 128 may be configured to use any one or more communication technology (e.g., wireless or wired communications) and associated protocols (e.g., Ethernet, InfiniBand® Bluetooth®, Wi-Fi®, WiMAX, 3G LTE, 5G, etc.) to effect such communication.

As discussed in more detail below, the computing devices 102 may be configured to transmit and receive data with each other and/or other devices of the system 100 over the network 104. The network 104 may be embodied as any number of various wired and/or wireless networks. For example, the network 104 may be embodied as, or otherwise include, a wired or wireless local area network (LAN), a wired or wireless wide area network (WAN), a cellular network, and/or a publicly-accessible, global network such as the Internet. As such, the network 104 may include any number of additional devices, such as additional computers, routers, stations, and switches, to facilitate communications among the devices of the system 100.

Figure 2:
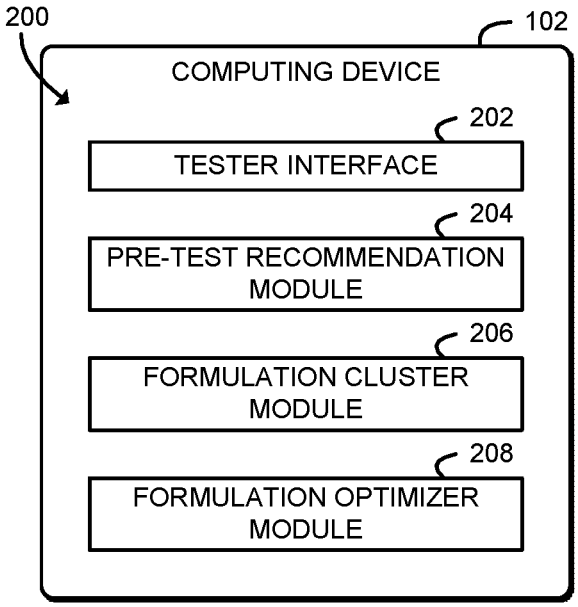
FIG. 2 is a simplified block diagram of an environment that may be established by a computing device of the system of FIG. 1.

Referring now to FIG. 2, in the illustrative embodiment, the computing device 102 establishes an environment 200 during operation. The illustrative environment 200 includes a tester interface 202, a pre-test recommendation module 204, a formulation cluster module 206, and a formulation optimizer module 208. The various components of the environment 200 may be embodied as hardware, firmware, software, or a combination thereof. As such, in some embodiments, one or more of the components of the environment 200 may be embodied as circuitry or a collection of electrical devices (e.g., pre-test recommendation circuitry 204, formulation cluster circuitry 206, and/or formulation optimizer circuitry 208). It should be appreciated that, in such embodiments, one or more of those components may form a portion of the processor 120, the I/O subsystem 122, and/or other components of the computing device 102.

The tester interface 202 is configured to receive a test description indicative of one or more test parameters for a test of a chemical formulation. The chemical formulation may be an oil field specialty chemical, such as a demulsifier, a dispersant, a corrosion inhibitor, a scale inhibitor and/or a defoamer. The one or more test parameters may include an oil field process parameter such as a geometrical location, a treating temperature, a treating pressure, a reservoir type, a crude oil pump method parameter, or a crude oil characterization. The tester interface 202 may be further configured to receive multiple test results that are each indicative of a performance indicator for a corresponding chemical formulation. The performance indicator may include turbidity, top oil total water content, or water recovery speed. As described further below, in some embodiments, the tester interface 202 may be configured to generate or otherwise output reports including a pre-test recommendation, a list of representative candidate formulations, and/or predicted results for virtual formulations. In some embodiments, the tester interface 202 may import one or more parameters for machine learning, such as predictor/algorithm selection, a pruning parameter for random forest to avoid overfitting, or other machine learning parameters.

The pre-test recommendation module 204 is configured to search a database of historical test results based on similarity to the one or more test parameters of the test description to generate search results. Searching the database may include performing a multidimensional distance search of the historical test results based on the one or more test parameters. The pre-test recommendation module 204 is further configured to generate multiple candidate chemical formulations in response to a search of the database. Each candidate chemical formulation is associated with a search result.

The formulation cluster module 206 is configured to cluster candidate chemical formulations with an unsupervised machine learning algorithm to generate formulation clusters, and to select a representative chemical formulation for each of the formulation clusters. The unsupervised machine learning algorithm may be embodied as a k-means clustering algorithm.

The formulation optimizer module 208 is configured to train a predictor with the test results using a supervised machine learning algorithm. The predictor may be embodied as a regressor or a classifier such as a random forest classifier. The formulation optimizer module 208 is further configured to generate multiple virtual formulation candidates. Each virtual formulation candidate is indicative of a proportion of one or more chemicals. The formulation optimizer module 208 is further configured to predict multiple predicted results using the predictor in response to training the predictor. Each predicted result is indicative of the performance indicator for a corresponding virtual formulation candidate. The formulation optimizer module 208 may be further configured to continue training the predictor with additional test results using the supervised machine learning algorithm.

Figure 3:
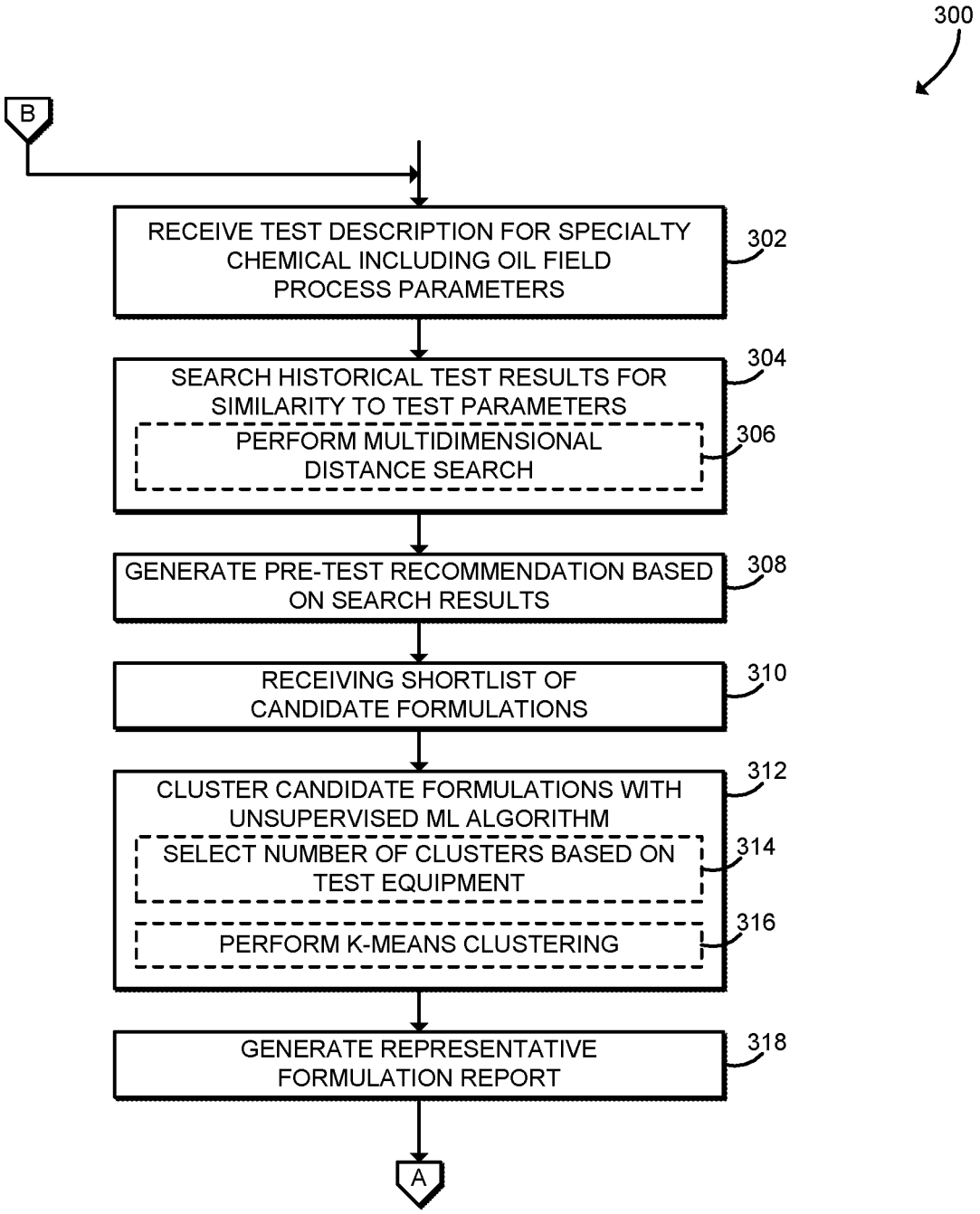
FIGS. 3 and 4 are exemplary flow diagrams of at least one embodiment of a method for specialty chemical development and testing that may be executed by the computing device of FIGS. 1 and 2.
Figure 4:
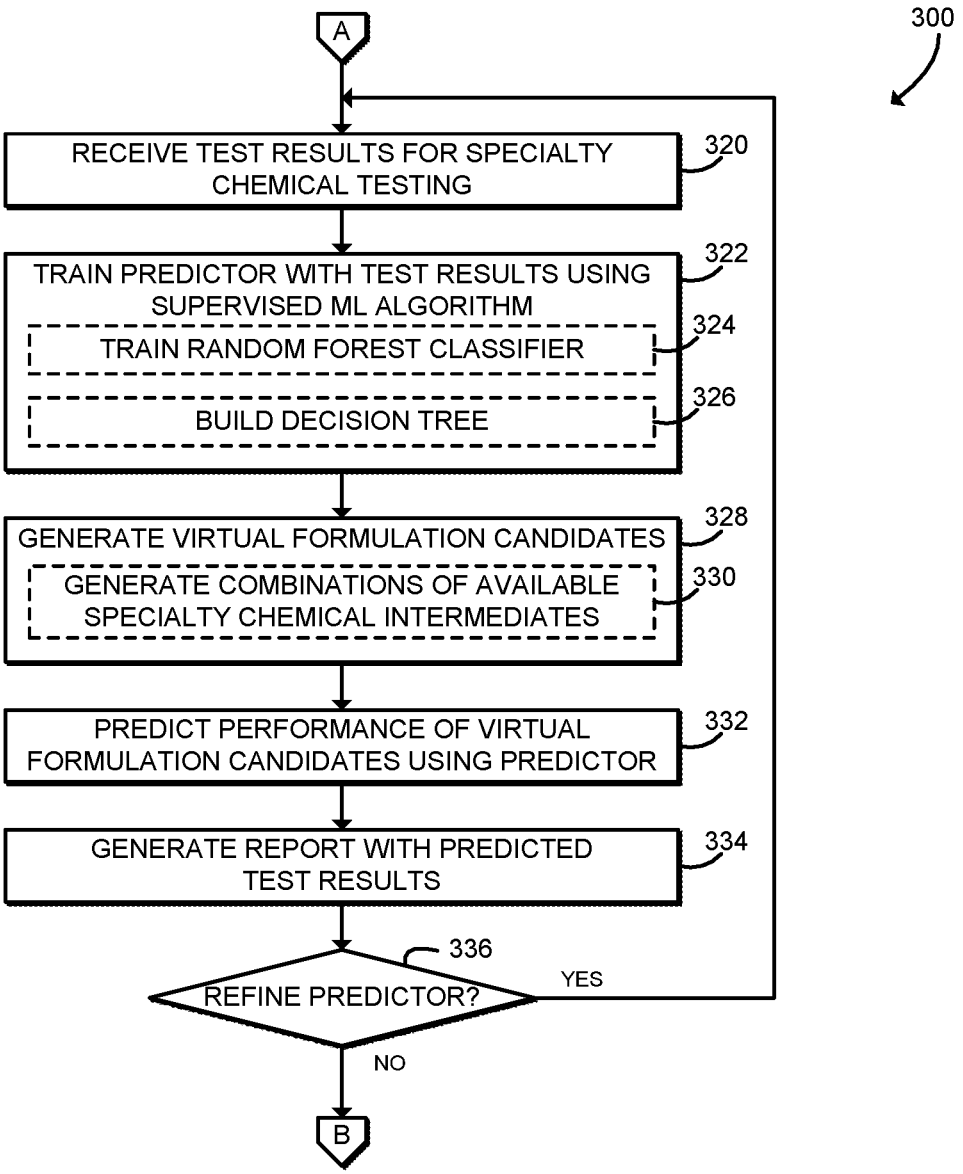

Referring now to FIGS. 3 and 4, in use, the computing device 102 may execute a method 300 for specialty chemical development and testing. It should be appreciated that, in some embodiments, the operations of the method 300 may be performed by one or more components of the environment 200 of the computing device 102 as shown in FIG. 2. The method 300 begins with block 302, in which the computing device 102 receives a test description for a test of an oil field specialty chemical, such as a demulsifier, a scale inhibitor, a dispersant, a corrosion inhibitor, a defoamer, and/or other specialty chemical. The test description includes one or more test parameters associated with a testing process for the specialty chemical. For example, the test parameters may include experimental design parameters such as bottle type or dosage size and/or one or more oil field process parameters such as geometrical location, a treating temperature, a treating pressure, a reservoir type, a crude oil pump method parameter, a crude oil characterization, or other process parameters. The test description may be provided by a tester or other user of the computing device 102, and may be provided for example through a web interface or other remote interface of the computing device 102. For example, the tester may upload one or more spreadsheets or other data files that include the test description to the computing device 102 using a web browser or other application executed by a remote computing device 102. Additionally or alternatively, the tester may provide the test description through a user application executed locally by the computing device 102. As described above, the test description may be included in a spreadsheet file, which may be based on one or more test template files that are made available to the tester or other user.

In block 304, the computing device 102 searches a database of historical test results for similarly to the test parameters received from the user. The historical test results may be stored in a relational database, an object database, a data lake, a database such as SQL, NoSQL, MongoDB, or other data store accessible by the computing device 102. Each search result may be associated with a historical test of a specialty chemical and thus may include information related to the test parameters of the historical test, the historical formulation that was tested, historical test result performance data, including values for key performance indicators, or other information related to the historical test. The computing device 102 may use any appropriate technique to search the historical test results for similarity. In some embodiments, in block 306, the computing device 102 performs a multidimensional distance search to identify similar historical test results. For example, the computing device 102 may process each of the supplied test parameters as a value in a particular dimension, and then calculate a Euclidean distance from the supplied test parameters to the historical test results. In some embodiments, the test parameters may be weighted when performing the search. In some embodiments, the tester may also provide custom weights for the test parameters.

In block 308, the computing device 102 generates a pre-test recommendation based on the search results. The pre-test recommendation may be embodied as a web page or other report that may be provided to the tester or other user. The pre-test recommendation includes information derived from the historical test results located by the search. For example, the pre-rest representative may include the most-related testing methods for a similar process, the best-performing product for similar process and similar crude oil characterization, any commercial products and formulations that have never been tested in a similar process, or other relevant information. Thus, the pre-test recommendation may include a list of chemical formulations that are candidates for further testing. The tester may use the pre-test recommendation to select chemical formulations for testing, adjust test methods or other parameters, or otherwise prepare for specialty chemical testing.

In block 310, the computing device 102 receives a shortlist of candidate formulations for further testing. The shortlist may be received, for example, from the tester or other user via a web interface of the computing device 102. Continuing that example, the tester may prepare the shortlist based on the pre-test recommendation that is generated as described above. Additionally or alternatively, in some embodiments, the computing device 102 may receive the shortlist of candidate formulations automatically or otherwise without additional user input. For example, a certain number of top search results determined as described above may be included in the shortlist of candidate formulations.

In block 312, the computing device 102 clusters the candidate formulations into multiple clusters using an unsupervised machine learning algorithm. Each cluster includes a grouping of similar candidate formulations selected from the shortlist of candidate formulations. That is, the chemical formulations included in a cluster may be more similar to each other than to formulations included in other clusters. The chemical formulations may be clustered based on one or more features of the formulation, such as a chemical type, a molecular weight, a chemical code, a numeric feature, or other feature. The computing device 102 may use any appropriate technique to cluster the candidate formulations. In some embodiments, in block 314 the computing device 102 may select a particular number of clusters based on available testing equipment. For example, if 12 samples may be tested in a particular batch, the computing device 102 may cluster the candidate formulations into 11 clusters, leaving one testing position open for an incumbent chemical or other control. In some embodiments, in block 316 the computing device 102 may cluster the candidate formulations using a k-means clustering algorithm. Of course, in other embodiments, the computing device 102 may use any other appropriate unsupervised clustering algorithm, such as density-based spatial clustering of applications with noise (DBSCAN), hierarchical clustering, distribution models, density models, support vector clustering, or other clustering algorithm. In some embodiments, selection of the clustering algorithm may be guided or otherwise determined by the type of data associated with the candidate formulations. For example, certain algorithms may be better suited for input data with a Gaussian distribution.

In block 318, the computing device 102 generates a representative formulation report. To generate the report, the computing device 102 selects a representative formulation from each cluster determined as described above. The representative formulation may be, for example, a formulation that is closest to the center or centroid of each cluster, a formulation that is closest to the average of each cluster, or other formulation selected from the chemical formulations included in the cluster. The representative formulation report may be embodied as a web page or other report that may be provided to the tester or other user. The tester may use the representative formulation report to perform additional testing. For example, the tester may perform tests using each of the representative formulations and collect corresponding test results. Continuing the example described above, the representative formulation report may list 11 representative formulations, one representative formulation for each cluster. The tester may prepare a test including those 11 representative formulations plus a control formulation.

After generating the representative formulation report, the method 300 advances to block 320, shown in FIG. 4, in which the computing device 102 receives test results for specialty chemical testing. The test results may be received, for example, from the tester or other user via a web interface of the computing device 102. Each of the test results is associated with a particular chemical formulation that was tested, and may include measured values of key performance indicators (KPIs) such as turbidity, top oil total water content, water recovery speed, or results of testing the chemical formulation.

In block 322, the computing device 102 trains a predictor with the test results using a supervised machine learning algorithm. The predictor may be embodied as a regressor, a classifier, or any other supervised machine learning prediction model. The predictor may be trained to predict one or more predicted results (e.g., one or more predicted KPI values) for each input chemical formulation, for example all untested but commercially available formulations, or other input features. Test results received as described above may be used as labels or other training data. In some embodiments, in block 324, the computing device 102 may train a random forest classifier. In some embodiments, in block 326 the computing device 102 may build a decision tree to perform predictions. Additionally or alternatively, in some embodiments the computing device 102 may train any appropriate supervised learning model, such as an artificial neural network, support vector machine, linear regression, logistic regression, or other predictor or combination of predictors (e.g., a combination of random forest and gradient descent classifiers such as XGBoost).

In block 328, the computing device 102 generates multiple virtual formulation candidates. Each virtual formulation candidate identifies one or more constituent chemicals or other components of the formulation, and a corresponding proportion of that constituent chemical. In some embodiments, in block 330 the computing device 102 may generate combinations of commercially available specialty chemical intermediates. Thus, the virtual formulations may include blends of intermediates or other chemicals that both are and are not commercially available. As an illustrative example, the computing device 102 may generate all potential virtual formulations given a certain number of intermediates or other components, an available percentage range, and a percentage accuracy. Continuing that example, in an illustrative embodiment virtual formulations may be generated for blends of two chemicals, labeled intermediate A and intermediate B. The percentage range may be from zero to 100%, and the percentage accuracy may be 20%. In that example, the computing device 102 may generate six virtual formulations as shown below in Table 1. Of course, as the number of potential chemical intermediates increases, the number of virtual formulations may also increase. In some embodiments, the computing device 102 may generate hundreds or thousands of virtual formulation candidates.

TABLE 1

Illustrative virtual formulations.

| Virtual Formulation | Component A | Component B |
|---|---|---|
| VF01 | 100% | 0% |
| VF02 | 80% | 20% |
| VF03 | 60% | 40% |
| VF04 | 40% | 60% |
| VF05 | 20% | 80% |
| VF06 | 0% | 100% |

In block 332, the computing device 102 predicts performance of the virtual formulation candidates using the trained predictor. The computing device 102 may, for example, predict the values of one or more KPIs such as turbidity, top oil total water content, water recovery speed, or other indicators of performance. In some embodiments, the computing device 102 may classify the virtual formulation candidates or otherwise predict performance of the virtual formulation candidates using the predictor.

In block 334, the computing device 102 generates a report with the predicted results. The predicted result report may be embodied as a web page or other report that may be provided to the tester or other user. The user may use the predicted results to identify particular virtual formulation candidates for further testing. For example, the tester may identify certain virtual formulations having the best predicted performance for additional testing.

In block 336, the computing device 102 determines whether to refine the predictor. The computing device 102 may refine the predictor, for example, in response to additional testing that may be performed by the tester. In some embodiments, the computing device 102 may be connected to MLOps tools and workflows such as automated continuous integration, continuous delivery, and continuous training systems to perform further model calibration, data governance, and ML lifecycle operations. If the computing device 102 determines to refine the predictor, the method 300 loops back to block 320 to receive additional test results and continue training the predictor. If the computing device 102 determines not to refine the predictor, the method 300 loops back to block 302 shown in FIG. 3, in which the computing device 102 may process additional test descriptions.

Although illustrated in FIGS. 3 and 4 as performing the operations of the method 300 in sequence, it should be understood that in other embodiments, those operations may be performed independently or otherwise in a different ordering. For example, in some embodiments, the computing device 102 may perform clustering as described above in connection with block 312 on the virtual formulation candidates generated as described above in connection with block 328 in order to select a smaller number of representative virtual formulation candidates for further testing. Continuing that example, the computing device 102 may perform clustering on a predetermined percentage of top-performing virtual formulation candidates prior to testing. Additionally or alternatively, in some embodiments the computing device 102 may perform clustering at any other step prior to testing.

Referring now to FIG. 5, diagram 500 illustrates one potential embodiment of a test description 502 that may be received by the computing device 102. As described above, the test description 502 may embodied as a spreadsheet document or other file prepared by a tester or other user and provided to the computing device 102. As another example, the test description 502 may be embodied as a web form or other remote interface of the computing device 102 and/or a native application or other local interface of the computing device 102. As shown, the test description 502 includes multiple values 504 that may be provided by the tester. The values 504 may include test parameters, such as parameters defining the experiment design and/or oil process parameters. Additionally, the test description 502 further includes weights 506 that may be assigned by the tester. The weights 506 may be used when performing a weighted multidimensional search for similar historical test results, as described above. In the illustrative example, the tester has assigned each of treating temperature and treating dosage a weight of 25% and has assigned geographic location a weight of 50%. Of course, in other embodiments, the test description 502 may include different test parameters and/or weights.

Referring now to FIG. 6, diagram 600 illustrates one potential embodiment of a pre-test recommendation report 602 that may be generated by the computing device 102. As described above, in response to submission of a test description such as the test description 502 of FIG. 5, the computing device 102 searches a database of historical test results and then generates a pre-test recommendation report 602. The illustrative pre-test recommendation report 602 includes a top tested section 604, which lists details for top-ranked search results among the historical test results. The top tested section 604 may include information selected from the historical test results such as chemical name (e.g., formulation name, formulation code, trade name, or other identifier), composition, and test details (e.g., test date, test method, test performance, or other information). The computing device 102 may use any appropriate criteria to select the top test results. For example, the computing device 102 may select historical test results that are most similar to the test description 502 provided by the user. As another example, the computing device 102 may select test results based on test frequency. That is, the top tested section 604 may identify chemical formulations that are similar to the test description 502 and have the largest number of historical test results. As yet another example, the computing device 102 may select test results based on performance, such as based on value of a key performance indicator such as turbidity or water content.

As shown in FIG. 6, the pre-test recommendation report 602 also includes an untested formulation section 606. The untested formulation section 606 may list chemical formulations for which the database does not include any historical test results that are similar to the test description 502. For example, the computing device 102 may list formulations for which no historical test results exceed a predetermined similarity threshold with the test description 502.

Referring now to FIG. 7, diagram 700 illustrates one potential embodiment of formulation clustering 702 that may be performed by the computing device 102. The formulation clustering 702 is illustratively prepared from a shortlist of commercially available chemical formulations that is provided by the tester. For example, the shortlist may be developed by the tester based on the contents of the pre-test recommendation report 602 described above. Additionally or alternatively, it should be understood that the computing device 102 may perform formulation clustering on other lists of chemical formulations. For example, the computing device 102 may cluster a list of virtual formulations in connection with predicting test results.

In the illustrative formulation clustering 702, each chemical formulation is identified by a name (e.g., formulation name, formulation code, trade name, or other identifier) as well as a composition. The composition of each formulation is illustratively shown as different percentages of each of nine chemical intermediates, labeled as molecules G, H, M, K, I, A, C, L, and F. In other embodiments, each chemical formulation may include additional information, such as chemical intermediate type and/or code name. For example, each intermediate may be embodied as a particular resin, polymer, solvent, or other chemical intermediate that may be combined to form a formulation for testing as a demulsifier.

As shown in FIG. 7, the computing device 102 clusters the chemical formulas into three clusters 704, 706, 708. The chemical formulations within each of the clusters 704, 706, 708 share similar characteristics. As described above, the computing device 102 also identifies a representative formulation for each of the clusters 704, 706, 708. Illustratively, the computing device 102 identified formulations 710, 712, 714 as representative formulations for the clusters 704, 706, 708, respectively. As described above, the tester may select formulations 710, 712, 714 for further testing. Accordingly, the tester may effectively evaluate a large number of potential chemical formulations while performing physical testing on only a few of those formulations.

Referring now to FIG. 8, diagram 800 illustrates one potential embodiment of predicted results 802 that may be generated by the computing device 102. As described above, after training the predictor (e.g., a decision tree or a random forest classifier), the computing device 102 may generate a large number of virtual formulations and then use the predictor to predict performance for each of those virtual formulations. In the illustrative predicted results, each virtual formulation is identified by name (e.g., a virtual formulation code or other identifier) and composition. The illustrative test results show percentages of each of three chemical intermediates, labeled as molecules A, C, and F, for each virtual formulation. However, it should be understood that each virtual formulation may also include other chemical intermediates, and thus the percentages of molecules A, C, and F may not add to 100%. Each virtual formulation is also illustrated with a corresponding numeric feature 804, which may be embodied as a dimensionless number generated based on the composition of the virtual formulation.

As shown, the predicted results 802 include a predicted KPI score 806 for each virtual formulation. The KPI score 806 corresponds to a performance result generated by the predictor for that virtual formulation. For example, the KPI 806 may be embodied as a predicted score for turbidity, top oil total water content, water recovery speed, or other indicators of performance for a demulsifier or other specialty chemical. The KPI 806 may be reported in appropriate units or may be scaled. Illustratively, the KPIs 806 shown in FIG. 8 represent predicted scores for turbidity, scaled from zero to 1.0. Thus, of the 20 virtual formulations, the computing device 102 predicts that VF06 will have the best performance, and that VF13 will have the worst performance. In some embodiments, the test results 802 may include multiple KPIs 806 and/or composite KPIs 806 (e.g., weighted averages of multiple performance indicators). Additionally or alternatively, in some embodiments, design of experiments (DOE) principles may be used to assist in down-selecting candidate formulations more efficiently with analysis of multiple constraints and multiple outputs. A tester may use the predicted results 802 to identify candidate formulations for further testing, to narrow a shortlist of candidate formulations, as input to formulation clustering, or otherwise to continue testing.

The invention claimed is:

1. A computing device for specialty chemical development testing, the computing device comprising:

a tester interface to receive a test description indicative of a test parameter for a test of a chemical formulation, wherein the test parameter comprises an oil field process parameter; and a pre-test recommendation module to (i) search a database of historical test results based on similarity to the test parameter of the test description to generate a plurality of search results, and (ii) generate a plurality of candidate chemical formulations in response to a search of the database, wherein each of the plurality of candidate chemical formulations is associated with a search result of the plurality of search results.

2. The computing device of claim 1, wherein the chemical formulation comprises an oil field specialty chemical.

3. The computing device of claim 2, wherein the oil field specialty chemical comprises a demulsifier, a dispersant, a scale inhibitor, a corrosion inhibitor, or a defoamer.

4. The computing device of claim 1, wherein the oil field process parameter comprises a geometrical location, a treating temperature, a treating pressure, a reservoir type, a crude oil pump method parameter, or a crude oil characterization.

5. The computing device of claim 1, wherein to search the database comprises to perform a multidimensional distance search of the historical test results based on the test parameter.

6. The computing device of claim 1, further comprising a formulation cluster module to:

cluster the plurality of candidate chemical formulations with an unsupervised machine learning algorithm to generate a plurality of formulation clusters; and select a representative chemical formulation for each of the plurality of formulation clusters.

7. The computing device of claim 6, wherein:

the tester interface is further to receive a plurality of test results in response to selection of the representative chemical formulation, wherein each of the plurality of test results is indicative of a performance indicator for a corresponding representative chemical formulation; and the computing device further comprises a formulation optimizer module to train a predictor with the plurality of test results using a supervised machine learning algorithm.

8. The computing device of claim 7, wherein the performance indicator comprises turbidity, top oil total water content, or water recovery speed.

9. The computing device of claim 7, wherein the predictor comprises a regressor.

10. The computing device of claim 7, wherein the formulation optimizer module is further to:

generate a plurality of virtual formulation candidates, wherein each of the plurality of virtual formulation candidates is indicative of a proportion of a chemical; and predict a plurality of predicted results with the predictor in response to training of the predictor, wherein each of the plurality of predicted results is indicative of the performance indicator for a corresponding virtual formulation candidate of the plurality of virtual formulation candidates.

11. The computing device of claim 10, wherein:

the tester interface is further to receive a plurality of second test results in response to prediction of the plurality of predicted results, wherein each of the plurality of second test results is indicative of a performance indicator for a corresponding virtual formulation candidate of the plurality of virtual formulation candidates; and the formulation optimizer module is further to train the predictor with the plurality of second test results using the supervised machine learning algorithm.

12. A method for specialty chemical development testing, the method comprising:

receiving, by a computing device, a test description indicative of a test parameter for a test of a chemical formulation, wherein the test parameter comprises an oil field process parameter;

searching, by the computing device, a database of historical test results based on similarity to the test parameter of the test description to generate a plurality of search results; and generating, by the computing device, a plurality of candidate chemical formulations in response to searching the database, wherein each of the plurality of candidate chemical formulations is associated with a search result of the plurality of search results.

13. The method of claim 12, wherein searching the database comprises performing a multidimensional distance search of the historical test results based on the test parameter.

14. The method of claim 12, further comprising:

clustering, by the computing device, the plurality of candidate chemical formulations with an unsupervised machine learning algorithm to generate a plurality of formulation clusters; and selecting, by the computing device, a representative chemical formulation for each of the plurality of formulation clusters.

15. The method of claim 14, further comprising:

receiving, by the computing device, a test result in response to selecting the representative chemical formulation, wherein the test result is indicative of a performance indicator for a corresponding representative chemical formulation;

training, by the computing device, a predictor with the test result using a supervised machine learning algorithm;

generating, by the computing device, a plurality of virtual formulation candidates, wherein each of the plurality of virtual formulation candidates is indicative of a proportion of a chemical; and predicting, by the computing device, a plurality of predicted results with the predictor in response to training the predictor, wherein each of the plurality of predicted results is indicative of the performance indicator for a corresponding virtual formulation candidate of the plurality of virtual formulation candidates.

16. A non-transitory, computer-readable storage media comprising a plurality of instructions that in response to being executed cause a computing device to:

receive a test description indicative of a test parameter for a test of a chemical formulation, wherein the test parameter comprises an oil field process parameter;

search a database of historical test results based on similarity to the test parameter of the test description to generate a plurality of search results; and generate a plurality of candidate chemical formulations in response to searching the database, wherein each of the plurality of candidate chemical formulation is associated with a search result of the plurality of search results.

17. The computer-readable storage media of claim 16, wherein to search the database comprises to perform a multidimensional distance search of the historical test results based on the test parameter.

18. The computer-readable storage media of claim 16, further comprising a plurality of instructions that in response to being executed cause the computing device to:

cluster the plurality of candidate chemical formulations with an unsupervised machine learning algorithm to generate a plurality of formulation clusters; and select a representative chemical formulation for each of the plurality of formulation clusters.

19. The computer-readable storage media of claim 18, further comprising a plurality of instructions that in response to being executed cause the computing device to:

receive a plurality of test results in response to selecting the representative chemical formulation, wherein each of the plurality of test results is indicative of a performance indicator for a corresponding representative chemical formulation; and train a predictor with the plurality of test results using a supervised machine learning algorithm.

20. The computer-readable storage media of claim 19, further comprising a plurality of instructions that in response to being executed cause the computing device to:

generate a plurality of virtual formulation candidates, wherein each of the plurality of virtual formulation candidates is indicative of a proportion of a chemical; and predict a plurality of predicted results with the predictor in response to training the predictor, wherein each of the plurality of predicted results is indicative of the performance indicator for a corresponding virtual formulation candidate of the plurality of virtual formulation candidates.

* * * * *